US006030251A

United States Patent [19]

Stark et al.

[11] Patent Number: 6,030,251

[45] Date of Patent: Feb. 29, 2000

[54] KEYED INTERLOCK AND MECHANICAL ALIGNMENT INTEGRATED MECHANICAL RETENTION FEATURES FOR PC SYSTEM

[75] Inventors: Michael Stark, Tempe; Michael Rutigliano, Chandler, both of Ariz.; Bill Lieska, Shelton; Peter A Davison, Sumner, both of Wash.; James S. Webb, Portland, Oreg.

[73] Assignee: Intel Corporation, Santa Clara, Calif.

[21] Appl. No.: 09/024,741

[22] Filed: Feb. 17, 1998

[51] Int. Cl.[7] ..... H01R 13/64

[52] U.S. Cl. ..... 439/377; 439/573

[58] Field of Search ..... 439/64, 328, 354, 439/377, 573, 569, 564

[56] References Cited

U.S. PATENT DOCUMENTS 3,932,016 1/1976 Ammenheuser ..... 439/377
5,066,246 11/1991 Jensik ..... 439/564
5,676,555 10/1997 Yu et al. ..... 439/328
5,689,405 11/1997 Bethurum ..... 439/328
5,726,865 3/1998 Webb et al. ..... 439/328

*Primary Examiner*—Khiem Nguyen
*Assistant Examiner*—T C Patel
*Attorney, Agent, or Firm*—Blakely, Sokoloff, Taylor & Zafman LLP

[57] ABSTRACT

A retention system for an electronic cartridge which mates with connector that is mounted to a substrate. The system may include a first guide rail that is adapted to receive one edge of the electronic cartridge and a second guide rail that is adapted to receive another edge of the electronic cartridge. The guide rails may be mounted to the motherboard by a plurality of threaded fasteners and corresponding nuts. The guide rails guide the electronic cartridge into the connector. The system may further have a beam that extends from the first guide rail to the second guide rail. The guide rails and beam provide structural support for the electronic cartridge.

11 Claims, 3 Drawing Sheets

FIG. 3
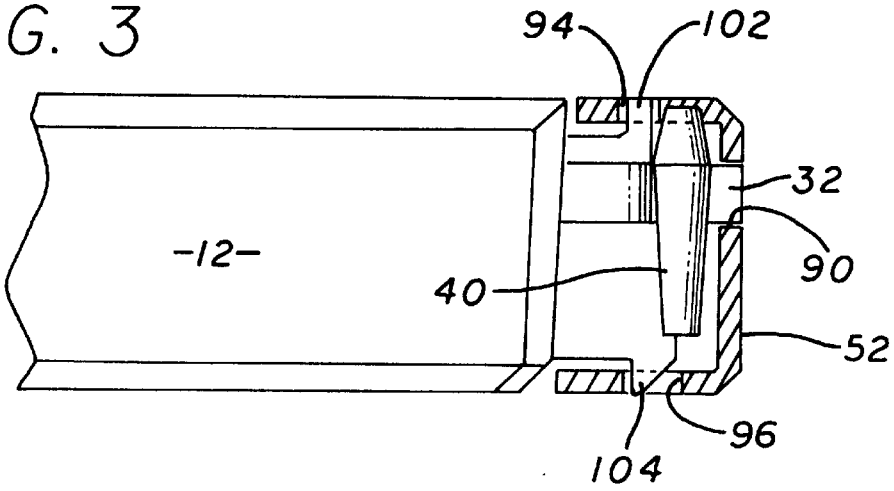
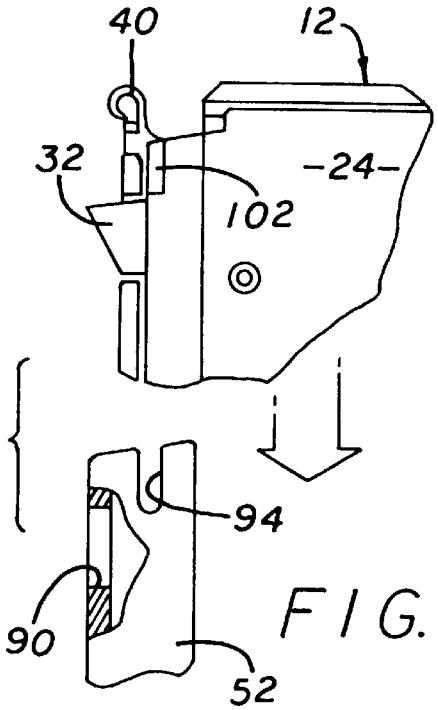
FIG. 4
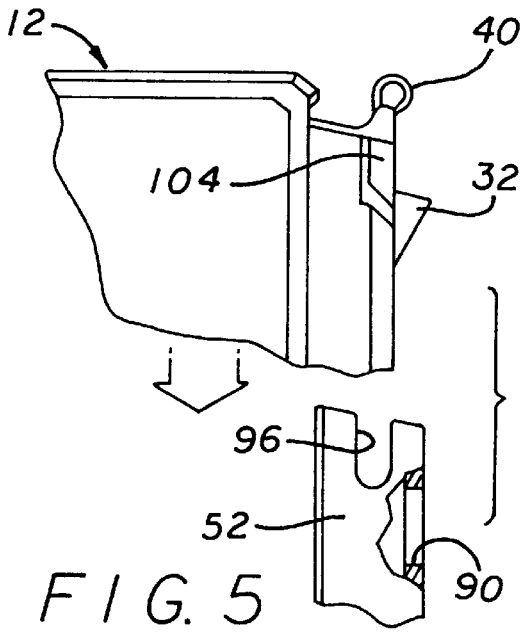
FIG. 5
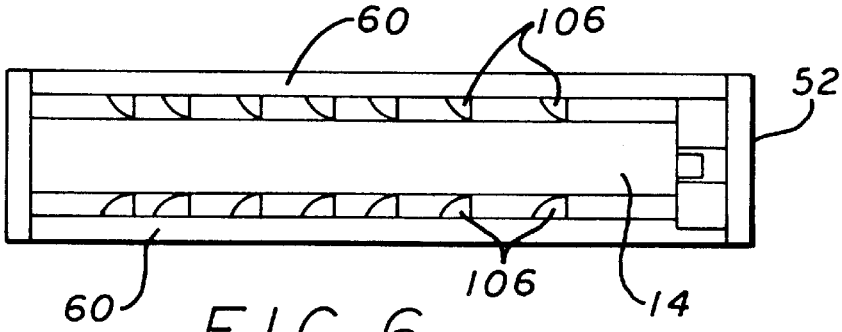
FIG. 6

KEYED INTERLOCK AND MECHANICAL ALIGNMENT INTEGRATED MECHANICAL RETENTION FEATURES FOR PC SYSTEM

BACKGROUND OF THE INVENTION

1. Field of the Invention

The present invention relates to a retention system for retaining an electronic cartridge.

2. Backgroung Information

Integrated circuits are typically assembled to packages that are mounted to a printed circuit board. The printed circuit board may have a plurality of conductive pads which plug into a mating connector. The mating connector may be mounted to a motherboard of a computer system. The conductive pads must be aligned with corresponding contacts of the connector to properly connect the printed circuit board with the motherboard. Plugging the circuit board into the motherboard connector is typically a manual process which requires a certain level of skill to align the pads and contacts of the connector.

Some computer systems contain mechanical guide rails which receive the edges of the printed circuit board and align the pads with the contacts when the board is being plugged into the connector. The circuit board must be plugged into the connector in the correct orientation to properly operate within a computer system. It is therefore desirable to provide a keying feature which will insure that the circuit board is always plugged into the motherboard connector in the proper orientation.

Computer systems are sometimes exposed to shock and vibration loads. The shock and vibration loads create stresses in the printed circuit board and the motherboard connector. The guide rails are typically mounted to a metal frame of a computer which provides structural support for the circuit board and the connector. It is not always feasible to mount the guide rails to a frame of a computer. It would be desirable to provide a guide rail system that is not attached to a frame and which still provides structural support for a printed circuit board assembly plugged into a motherboard connector. It would also be desirable to provide alignment features to insure that the guide rails are properly assembled relative to the motherboard connector so that the circuit board assembly is always plugged into the connector in a proper orientation.

SUMMARY OF THE INVENTION

One embodiment of the present invention is a retention system for an electronic cartridge which mates with a connector that is mounted to a substrate. The system may include a first guide rail that is adapted to receive one edge of the electronic cartridge and a second guide rail that is adapted to receive another edge of the electronic cartridge. The system may further have a beam that extends from the first guide rail to the second guide rail.

BRIEF DESCRIPTION OF THE DRAWINGS

FIG. 3 is a top view showing a latch within the retention system;

FIG. 4 is a side view showing a pair of left key tabs of an electronic cartridge located within key slots of the retention system;

FIG. 5 is a rear view of the assembly shown in FIG. 4;

FIG. 6 is a top view of an alternate embodiment of the retention system.

DETAILED DESCRIPTION OF THE INVENTION

One embodiment of the present invention is a retention system for an electronic cartridge which mates with a connector that is mounted to a substrate. The system may include a first guide rail that is adapted to receive one edge of the electronic cartridge and a second guide rail that is adapted to receive another edge of the electronic cartridge. The guide rails may be mounted to the motherboard by a plurality of threaded fasteners and corresponding nuts. The guide rails guide the electronic cartridge into the connector. The system may further have a beam that extends from the first guide rail to the second guide rail. The guide rails and beam provide structural support for the electronic cartridge.

Figure 1:
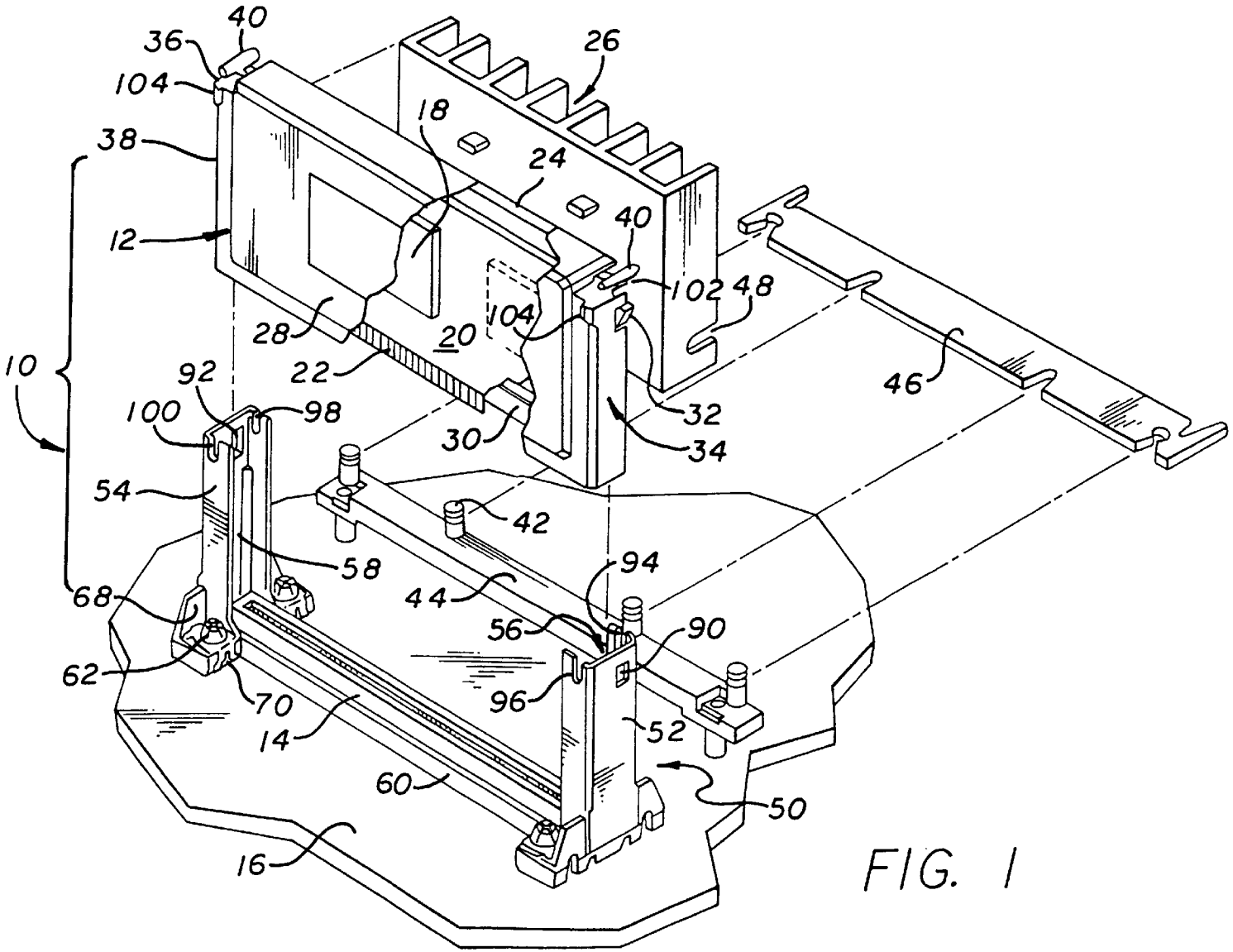
FIG. 1 is a perspective view of an embodiment of an electrical assembly of the present invention.

Referring to the drawings more particularly by reference numbers, FIG. 1 shows an embodiment of an electrical assembly 10 of the present invention. The assembly 10 may include an electronic cartridge 12 which can be plugged into an electrical connector 14. The electrical connector 14 may be mounted to a substrate 16 such as a motherboard of a computer system (not shown).

The electronic cartridge 12 may include one or more integrated circuit packages 18 that are mounted to a substrate 20. The substrate 20 may be a printed circuit board which has routing traces, power/ground planes, vias, etc., as is known in the art. The packages 18 typically contain integrated circuits (not shown) such as a microprocessor, memory, etc. One edge of the substrate 20 may have a plurality of conductive pads 22 that can be inserted into the electrical connector 14.

The electronic cartridge 12 may include a thermal plate 24 that is attached to the substrate 20 and thermally coupled to the integrated circuit packages 18. A heat sink 26 may be attached to the thermal plate 24. The thermal plate 24 and heat sink 26 facilitate the removal of heat generated by the integrated circuits.

The cartridge 12 may further have a cover 28 that is attached to the thermal plate 24. The cover 28 and plate 24 enclose the integrated circuit packages 18 of the cartridge 12. The electronic cartridge 12 may also have a shield 30 that inhibits human contact with the conductive pads 22 of the substrate 20.

The electronic cartridge 12 may further have a first latch 32 located at a first edge 34 of the cartridge 12 and a second latch 36 located at a second opposite edge 38 of the cartridge 12. The first and second latches 32 and 36 may each have a lever 40 which can be depressed by an operator to move each latch between an engaged position and a disengaged position.

The electrical system 10 may include a plurality of posts 42 that extend from a base plate 44 which is mounted to the motherboard 16. A tie bar 46 may be snapped onto the posts 42 and inserted into a corresponding groove 48 of the heat sink 26. The tie bar 46, posts 42 and base plate 44 may support the heat sink 26.

Figure 2:
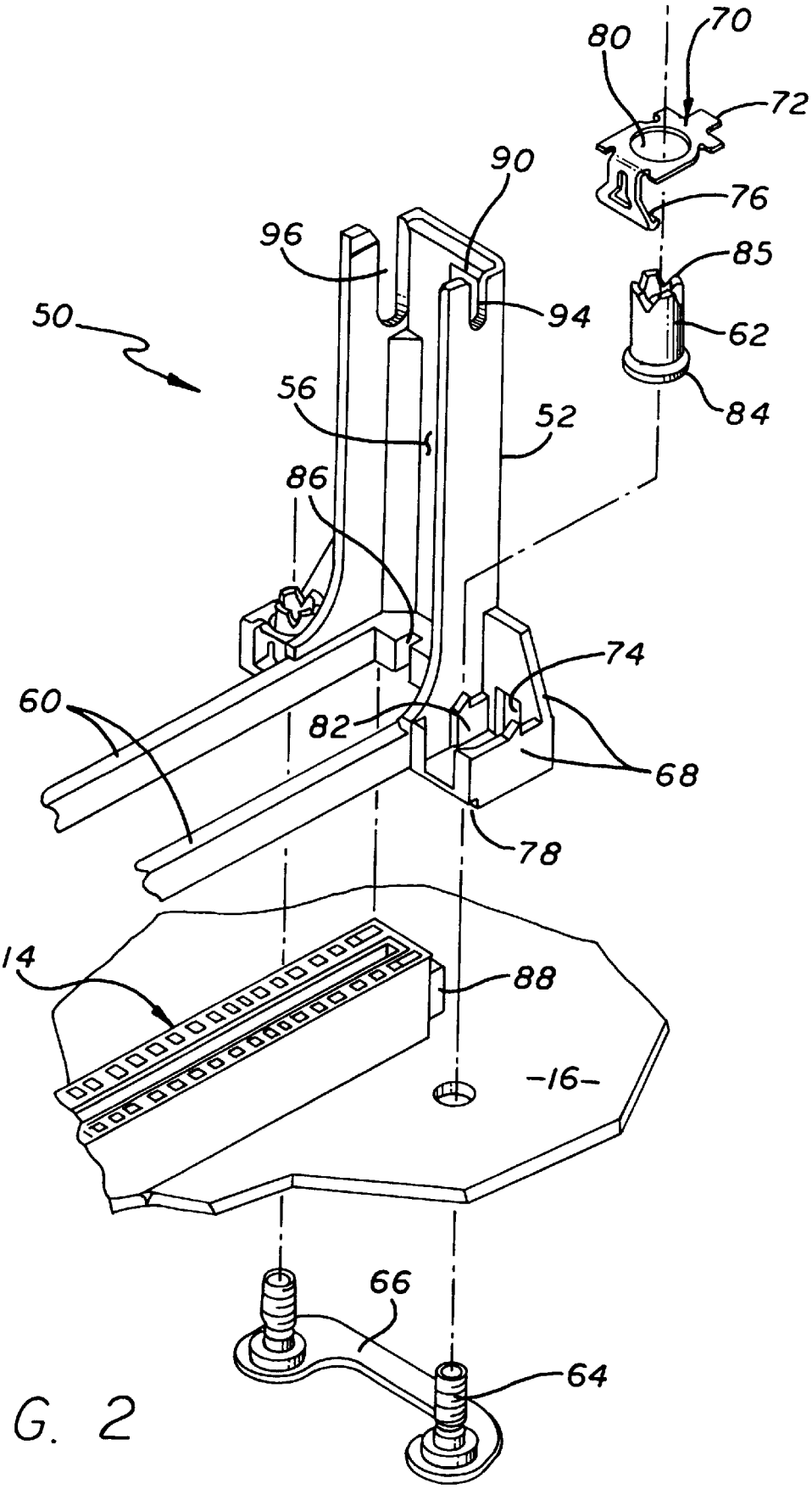
FIG. 2 is an exploded view of a retention system of the assembly.

As shown in both FIG. 2 and FIG. 1, the electrical system 10 may further have a retention system 50 which both mechanically supports the electronic cartridge 12 and guides the conductive pads 22 into the electrical connector 14. The retention system 50 may include a first guide rail 52 and a second guide rail 54. The first guide rail 52 may have a C-shaped guide channel 56 that receives the first edge 34 of the cartridge 12. The second guide rail 54 may also have a C-shaped guide channel 58 that receives the second edge 38 of the cartridge 12.

The retention system 50 may include a pair of beams 60 that extend from the first guide rail 52 to the second guide rail 54 along the sides of the connector 14. In addition to linking the guide rails together, the beams 60 also provide structural support for the electronic cartridge 12 when the cartridge 12 is plugged into the connector 14. The beam 60 and guide rails 52 and 54 may be constructed as a single integrally molded part.

The guide rails 52 and 54 are mounted to the motherboard 16 by a plurality of nuts 62 that are attached to a plurality of threaded fasteners 64. The threaded fasteners 64 may be pressed into the motherboard 16. A pair of fasteners 64 may be connected by a common bracket 66. The bracket 66 allows two fasteners 64 to be pressed into the motherboard 16 at the same time, thereby simplifying the assembly process of the retention system 50.

The nuts 62 may be captured within flanges 68 of the guide rails 52 and 54 by clips 70. Each clip 70 may have one edge 72 that snaps onto a first slot 74 of a flange 68 and a lip 76 that extends into a second slot 78 of the flange 68. The nuts 62 may extend through openings 80 in the clips 70 from corresponding cavities 82 of the flanges 68. The nuts 62 may each have a collar 84 which has a diameter that is larger than the diameter of the openings 80. The collars 84 prevent the nuts 62 from falling out of the cavities 82. The nuts 62 may also have slots 85 which allow an operator to attach the nuts 62 to the fasteners 64 with a tool (not shown) such as a screwdriver.

The first guide rail 52 may have a connector alignment slot 86 which receives a corresponding alignment tab 88 of the electrical connector 14. The tab 88 and slot 86 insure that the guide rails 52 and 54 are assembled to the motherboard 16 with a desired orientation relative to the connector 14.

Referring to FIG. 1–5, the first guide rail 52 may have a first latch slot 90 that receives the first latch 32 of the cartridge 12 and a second latch slot 92 that receives the second latch 36 of the cartridge 12. The latches 32 and 36 extend into the slots 90 and 92 when the conductive pads 22 are plugged into the connector 14. The latches 32 and 36 further secure the electronic cartridge 12 to the connector 14. The levers 40 can be depressed to pull the latches 32 and 36 out of the slots 90 and 92 before the cartridge 12 is pulled out of the connector 14.

The first guide rail 52 may have a first upper key slot 94 and a first lower key slot 96. The second guide rail 54 may include a second upper key slot 98 and a second lower key slot 100. Each edge 34 and 38 of the electronic cartridge 12 may have an upper key tab 102 and a lower key tab 104. The upper key tabs 102 are inserted into the upper key slots 94 and 98 when the cartridge 12 is plugged into the connector 14. Likewise, the lower key tabs 104 are inserted into the lower slots 96 and 100.

The upper slots 94 and 98 are located at a distance from the motherboard 16 that is different from a distance that separates the lower slots 96 and 100 from the motherboard 16. Likewise, when the assembly 12 is plugged into the connector 14, the upper tabs 102 are separated from the motherboard 16 a distance that is different than the distance separating the motherboard 16 and the lower tabs 104. The unequal distances prevent the lower tabs 104 from being fully inserted into the upper slots 94 and 98 when the cartridge 12 is plugged into the connector 14. The slots 94, 96, 98 and 100 and tabs 102 and 104 insure that the cartridge 12 is always plugged into the connector 14 in the proper orientation.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, as shown in FIG. 6, the beams 60 may have ribs 106 that are pressed into the connector 14. The ribs 106 transfer loads that are transmitted from the cartridge 12 to the guide rails 52 and 54.

What is claimed is:

1. A retention system for an electronic cartridge which has a first edge and a second edge, and which mates with a connector that is mounted to a substrate, comprising:

a first guide rail that is adapted to guide the first edge of the electronic cartridge, said first guide rail having a first right side wall with a first upper key slot and a first left side wall with a first lower key slot;

a second guide rail that is adapted to guide the second edge of the electronic cartridge, said second guide rail having a second left side wall having a second upper key slot and a second right side wall having a second lower key slot.

2. The retention system as recited in claim 1, further comprising a plurality of threaded fasteners that are adapted to be attached to the substrate and are attached to said first and second guide rails by a plurality of nuts.

3. The retention system as recited in claim 2, further comprising a bridge that is attached to a pair of said threaded fasteners.

4. The retention system as recited in claim 2, further comprising a plurality of clips that are attached to said first and second guide rails and which capture said nuts.

5. The retention system as recited in claim 1, wherein said first and second guide rails each have a latch slot.

6. The retention system as recited in claim 1, wherein said first guide rail includes a connector alignment slot.

7. A retention system for an electronic cartridge which has a first edge and a second edge, and which mates with a connector that is mounted to a substrate, comprising:

a first guide rail that is adapted to guide the first edge of the electronic cartridge;

a second guide rail that is adapted to guide the second edge of the electronic cartridge;

a beam that extends from said first guide rail to said second guide rail;

a plurality of threaded fasteners that are adapted to be attached to the substrate;

a plurality of nuts that attach said threaded fasteners to said first and second guide rails; and, a plurality of clips that are attached to said first and second guide rails and which capture said nuts and allow said nuts to move relative to said first and second guide rails.

8. The retention system as recited in claim 7, further comprising a bridge that is attached to a pair of said threaded fasteners.

9. The retention system as recited in claim 7, wherein said first and second guide rails each have a latch slot.

10. The retention system as recited in claim 7, wherein said first and second guide rails each have a pair of key slots.

11. The retention system as recited in claim 7, wherein said first guide rail includes a connector alignment slot.

* * * * *